US011566471B2

(12) United States Patent
Nguyen

(10) Patent No.: US 11,566,471 B2
(45) Date of Patent: Jan. 31, 2023

(54) SELECTIVELY OPENABLE COMMUNICATION PORT FOR A WELLBORE DRILLING SYSTEM

(71) Applicant: Tuan Nguyen, Pearland, TX (US)

(72) Inventor: Tuan Nguyen, Pearland, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 17/086,538

(22) Filed: Nov. 2, 2020

(65) Prior Publication Data

US 2022/0136331 A1 May 5, 2022

(51) Int. Cl.
*E21B 7/06* (2006.01)
*E21B 23/01* (2006.01)
*E21B 29/06* (2006.01)

(52) U.S. Cl.
CPC ..... *E21B 7/061* (2013.01); *E21B 23/01* (2013.01); *E21B 29/06* (2013.01)

(58) Field of Classification Search
CPC ..... E21B 7/06; E21B 23/01; E21B 29/06
See application file for complete search history.

(56) References Cited

U.S. PATENT DOCUMENTS 5,180,016 A 1/1993 Ross et al.
6,311,790 B1 * 11/2001 Beckwith ..... E21B 7/064 175/320
2001/0040055 A1 * 11/2001 Olsson ..... F16K 15/026 175/340
2009/0044944 A1 * 2/2009 Murray ..... E21B 43/26 166/308.1
2013/0312965 A1 * 11/2013 Themig ..... E21B 34/063 166/285
2014/0151052 A1 * 6/2014 Themig ..... E21B 17/18 166/308.1
2015/0361764 A1 12/2015 Cronley
2016/0348456 A1 * 12/2016 LaPlante ..... E21B 29/06
2018/0195346 A1 7/2018 Bulloch et al.
2019/0128094 A1 5/2019 Petrie et al.

FOREIGN PATENT DOCUMENTS

WO 2005049960 A1 6/2005

OTHER PUBLICATIONS

International Search Report and Written Opinion for International Application No. PCT/US2021/057551; International Filing Date Nov. 1, 2021; Report dated Feb. 23, 2022 (pp. 1-9).

* cited by examiner

*Primary Examiner* — Christopher J Sebesta
*Assistant Examiner* — Lamia Quaim
(74) *Attorney, Agent, or Firm* — Cantor Colburn LLP

(57) ABSTRACT

A window mill is positionable in a wellbore having an annulus. The window mill includes a mill body having an outer surface, a conduit extending axially through the mill body, and a flow port extending from the conduit through the outer surface. A nozzle shuttle including a nozzle is arranged in the conduit. The nozzle shuttle selectively extending over the flow port. A selectively openable port adapter extends between the flow port and the nozzle shuttle. The selectively openable port adapter is responsive to fluid pressure to fluidically expose the conduit to the annulus through the flow port.

20 Claims, 8 Drawing Sheets

SELECTIVELY OPENABLE COMMUNICATION PORT FOR A WELLBORE DRILLING SYSTEM

BACKGROUND

In the drilling and completion industry, boreholes are formed in a formation for the purpose of locating, identifying, and withdrawing formation fluids. Once formed, a casing may be installed in the borehole to support the formation. Often times, it is desirable to create a branch from the borehole. A whipstock is used to guide a window mill supported on a drillstring through the casing into the formation at an angle relative to the borehole. The whipstock directs the window mill to form a window or opening in the casing.

Generally, whipstock is lowered into the wellbore, oriented, and disconnected from the window mill to form the branch. To disconnect the whipstock from the window mill, fluid is introduced into the wellbore and pressure is applied. The fluid passes into a port in the window mill to initiate a disconnection process. Often times, the port may be clogged by drilling debris and mud.

If the port is clogged, the whipstock and window mill is withdrawn from the borehole, cleaned, and re-introduced to the desired position at a selected orientation. Tripping out and running in the whipstock can be a difficult and time-consuming process. Given the need to increase efficiency at the rig floor, the art would be open to new systems for guiding fluid into the window mill to initiate the separation process.

SUMMARY

Disclosed is a window mill positionable in a wellbore having an annulus. The window mill includes a mill body having an outer surface, a conduit extending axially through the mill body, and a flow port extending from the conduit through the outer surface. A nozzle shuttle including a nozzle is arranged in the conduit. The nozzle shuttle selectively extending over the flow port. A selectively openable port adapter extends between the flow port and the nozzle shuttle. The selectively openable port adapter is responsive to fluid pressure to fluidically expose the conduit to the annulus through the flow port.

Also disclosed is a resource exploration and recovery system including a surface system and a sub-surface system including a tubular string extending into a borehole and surrounded by an annulus. The tubular string supports a bottom hole assembly having a window mill coupled to a whipstock. The window mill includes a mill body having an outer surface, a conduit extending axially through the mill body, and a flow port extending from the conduit through the outer surface. A nozzle shuttle including a nozzle is arranged in the conduit. The nozzle shuttle selectively extends over the flow port. A selectively openable port adapter extends between the flow port and the nozzle shuttle. The selectively openable port adapter is responsive to fluid pressure to fluidically expose the conduit to the annulus through the flow port.

Still further disclosed is a method of anchoring a whipstock in a wellbore including running a tubular string including a window cutting system having a window mill and a whipstock into a wellbore, orienting the whipstock at a selected direction, flowing fluid into the window cutting system into the window mill, opening a port adapter with the flow of fluid, and passing the flow of fluid through the port adaptor into an annulus of the wellbore.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
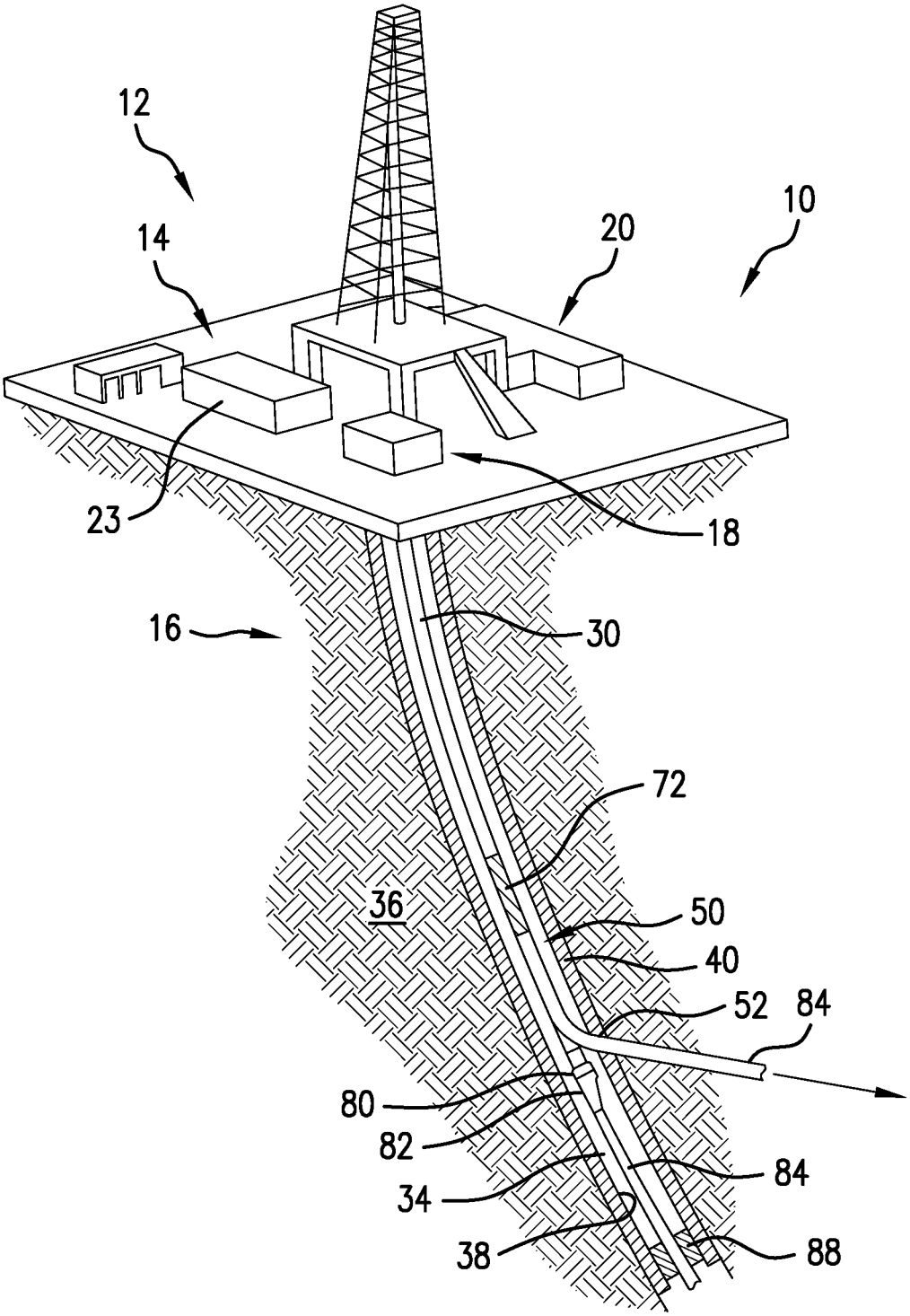
FIG. 1 depicts a resources exploration and recovery system including a window mill to whipstock connection system including a selectively openable communication port, in accordance with an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 12 which, in some environments, may take the form of a surface system 14 operatively and fluidically connected to a second system 16 which, in some environments, may take the form of a subsurface system.

First system 12 may include pumps 18 that aid in completion and/or extraction processes as well as fluid storage 20. Fluid storage 20 may contain a stimulation fluid which may be introduced into second system 16. First system 12 may also include a control system 23 that may monitor and/or activate one or more downhole operations. Second system 16 may include a tubular string 30 formed from a plurality of tubulars (not separately labeled) that is extended into a wellbore 34 defined by an annulus (not separately labeled)

formed in formation 36. Wellbore 34 includes an annular wall 38 that may be defined by a casing tubular 40 that extends from first system 12 towards a toe (not shown) of wellbore 34.

Figure 2:
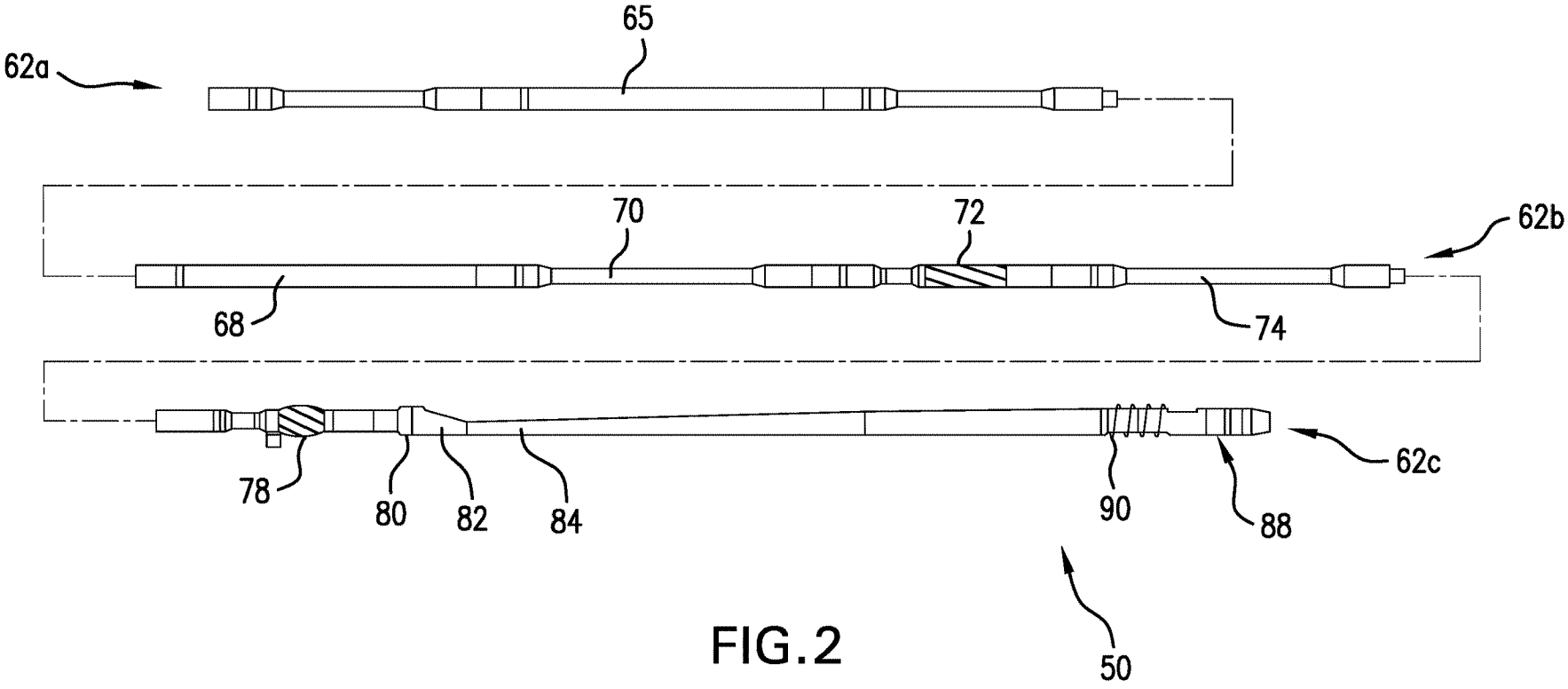
FIG. 2 depicts a window cutting system including a window mill and whipstock connector including the selectively openable communication port, in accordance with an exemplary embodiment.

In accordance with an exemplary aspect, tubular string 30 includes a bottom hole assembly (BHA) that includes a window cutting system 50 is connected to tubular string 30 and run into wellbore 34. Window cutting system 50 is lowered to a selected depth, affixed to casing tubular 40, and activated to form a window 52. Window 52 defines an opening (not separately labeled) in casing tubular 40 that allows a branch to be formed from wellbore 34. In the embodiment shown, window cutting system 50 is formed from a number of tubular segments 62*a*, 62*b*, and 62*c* as shown in FIG. 2. Each segment 62*a*, 62*b*, and 62*c* may be made up off-site and delivered to first system 12 for introduction into wellbore 34.

In an embodiment, first segment 62*a* may support a measurement while drilling (MWD) system 65 that includes various instrumentation systems that monitor window cutting operations. Second segment 62*b* may include a whipstock valve 68, a first flex joint 70, an upper watermelon mill 72, and a second flex joint 74. Third segment 62*c* may include a lower watermelon mill 78, a window mill 80, a whipstock 82, a whipstock connector 84, and an anchor 88. Third segment 62*c* may also support a brush or scraper 90 arranged adjacent to anchor 88.

Figure 3:
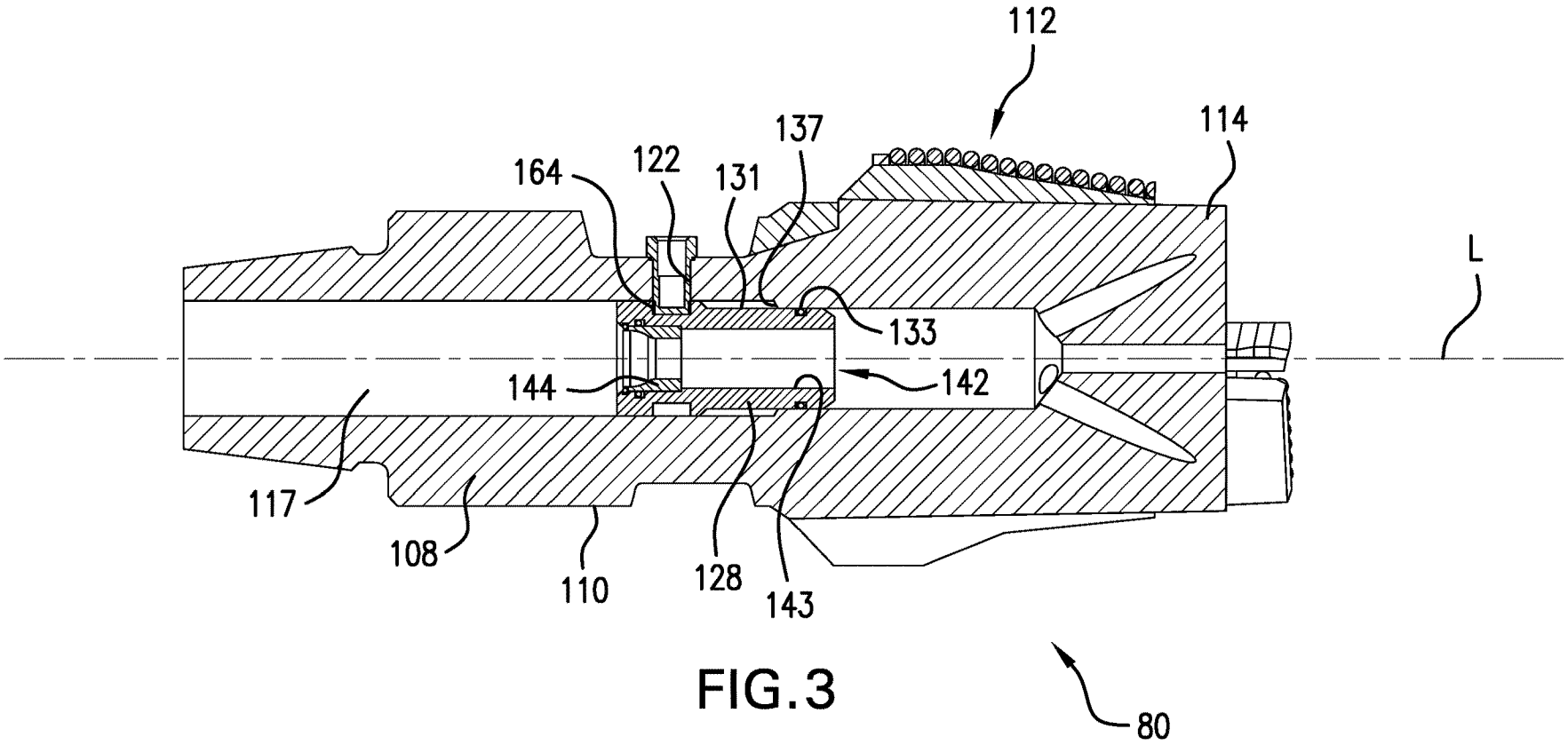
FIG. 3 depicts a cross-sectional side view of the window mill including the selectively openable communication port, in accordance with an exemplary embodiment.

Referring to FIG. 3, window mill 80 includes a mill body 108 having an outer surface 110 that supports a number of cutting elements indicated generally at 112. Mill body 108 includes an end 114 that is coupled to whipstock 82. A conduit 117 extends through mill body 108 along a longitudinal axis "L". A flow port 122 extends from conduit 117 through mill body 108. Flow port 122 may extend from conduit 117 at a substantially perpendicular angle. A nozzle shuttle 128 is slideably positioned within conduit 117 and selectively positioned over flow port 122.

Figure 4:
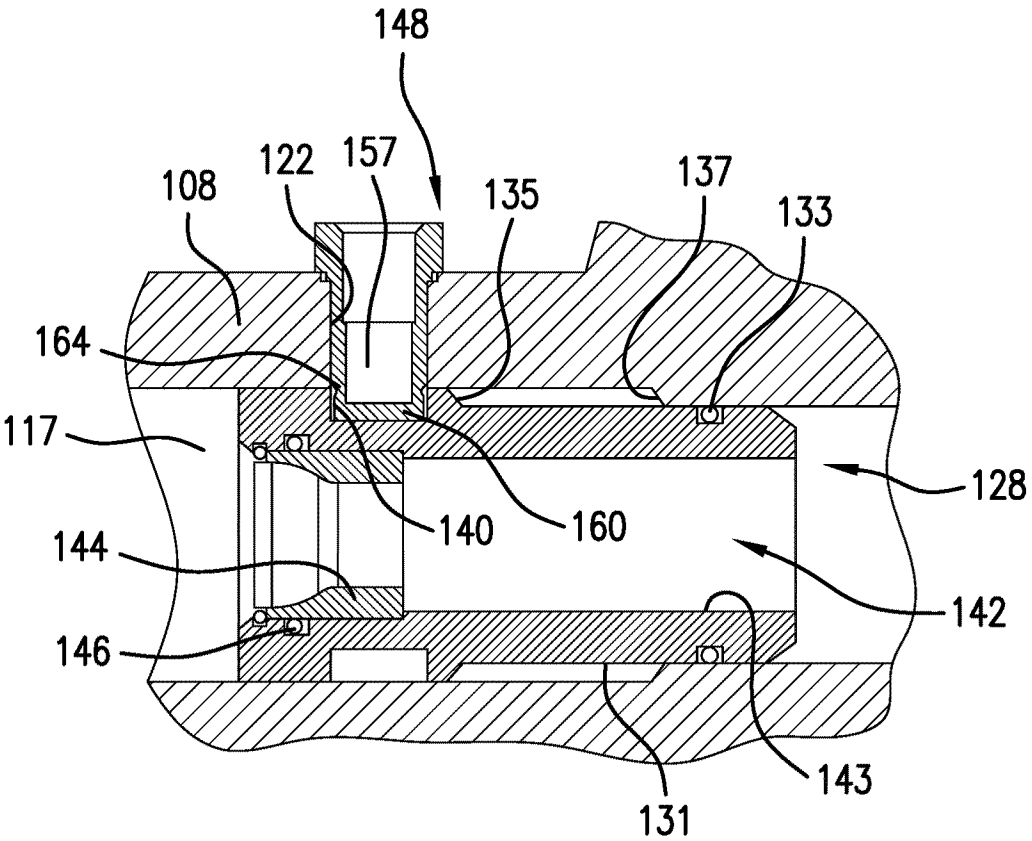
FIG. 4 depicts a cross-sectional side view of a portion of the window mill showing a nozzle shuttle held in place by the selectively openable communication port, in accordance with an exemplary embodiment.

In FIG. 4, nozzle shuttle 128 is shown to include an outer surface 131. A seal 133 is positioned on outer surface 131 and engages with a surface (not separately labeled) of conduit 117. Outer surface 131 also includes a travel stop 135 that engages with a shoulder 137 in conduit 117 to restrict axial movement of nozzle shuttle 128 along longitudinal axis "L". Nozzle shuttle 128 is also shown to include a recess 140, which may be annular, that extends into outer surface 131. A central passage 142 defined by an inner surface 143 extends through nozzle shuttle 128. A nozzle 144 is arranged in central passage 142. Central passage 142 supports a a seal 146 that abuts nozzle 144.

Figure 5:
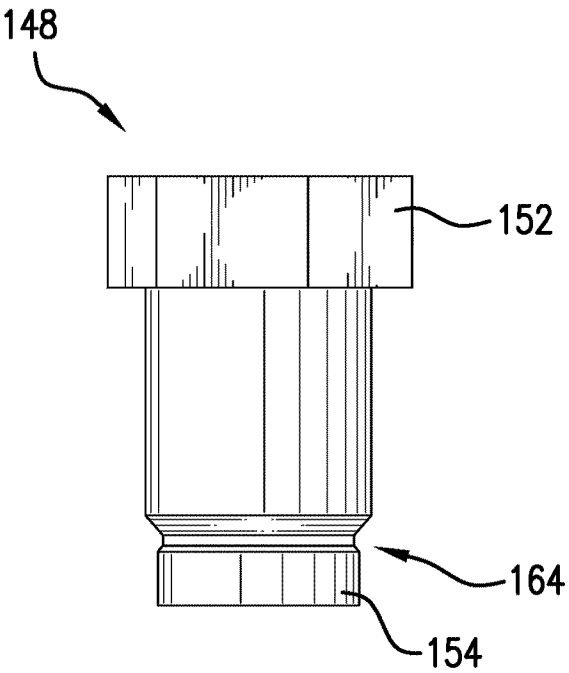
FIG. 5 depicts a plan view of the selectively openable communication port, in accordance with an exemplary embodiment.

A selectively openable port adapter 148 extends through flow port 122 into recess 140 to selectively restrict axial movement of nozzle shuttle 128. As shown in FIG. 5, port adapter 148 includes a first end 152 and a second end 154. A central passage 157 (FIG. 4) extends between first end 152 and second end 154. Second end 154 includes a closed end portion 160 that selectively prevents flow through central passage 157. An area of weakness or a shear zone 164 is arranged between first end 152 and second end 154.

Figure 6:
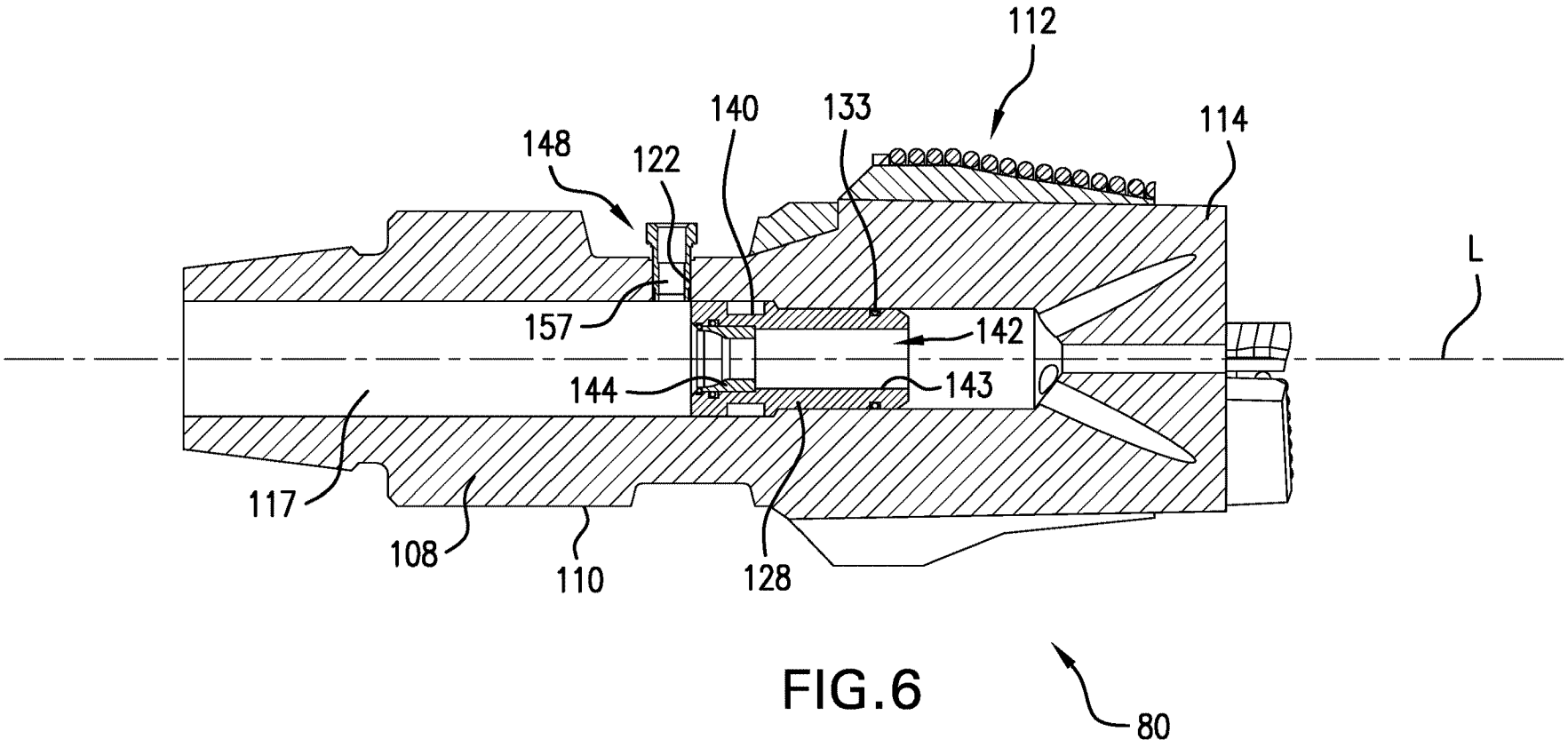
FIG. 6 depicts the nozzle shuttle having shifted after shearing an end portion of the selectively openable communication port, in accordance with an exemplary embodiment.

Window cutting system 50 is run into wellbore 34 with nozzle shuttle 128 covering port adapter 148 to a selected depth as shown in FIG. 3. Once at the selected depth, whipstock 82 is rotated to a selected orientation. Once at the selected orientation, fluid pressure is increased and directed along conduit 117 causing nozzle shuttle 128 to shift along longitudinal axis "L" causing shear zone 164 to fracture and thereby open port adaptor 148 to allow flow to the anchor as shown in FIG. 6. With the port to the anchor now exposed the pressure can then be increased to activate or set the anchor/packer. After activating anchor 88, window mill 80 may be disconnected from whipstock 82 and a window milling operation initiated.

Figure 7:
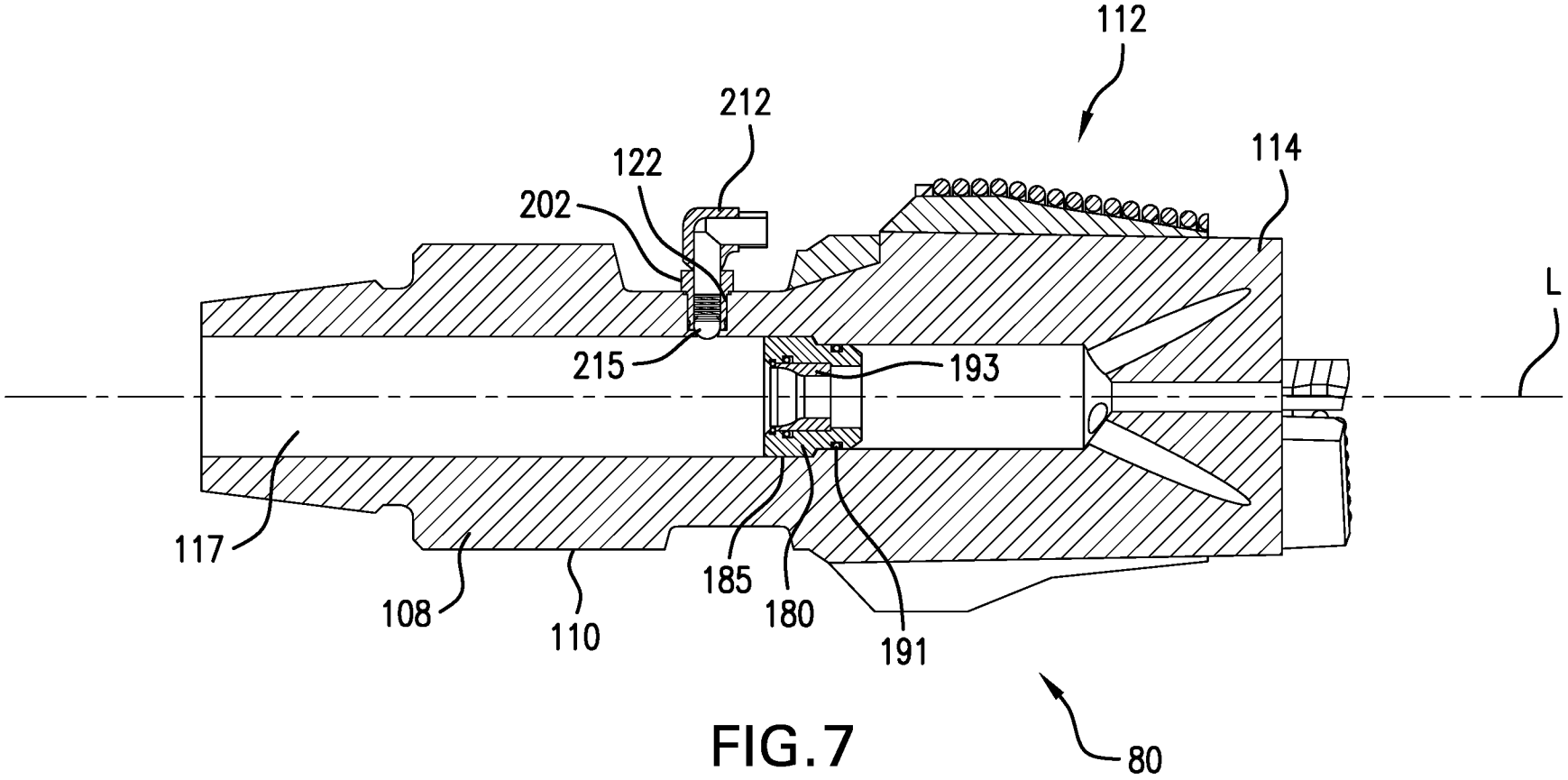
FIG. 7 depicts a window mill including a selectively openable communication port in a closed configuration, in accordance with another aspect of an exemplary embodiment.
Figure 8:
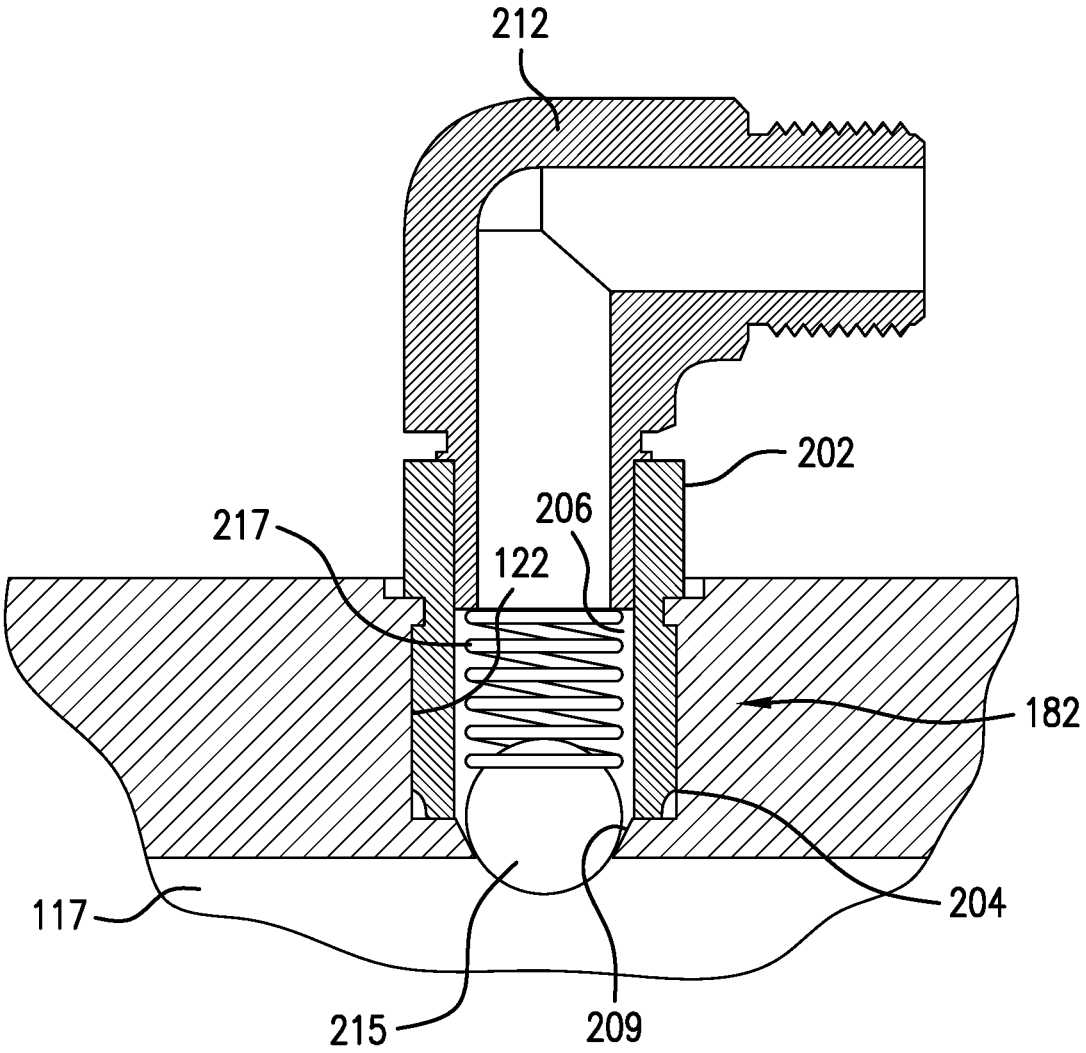
FIG. 8 depicts a cross-sectional side view of the selectively openable communication port of FIG. 7 in a closed configuration, in accordance with an aspect of an exemplary embodiment.
Figure 9:
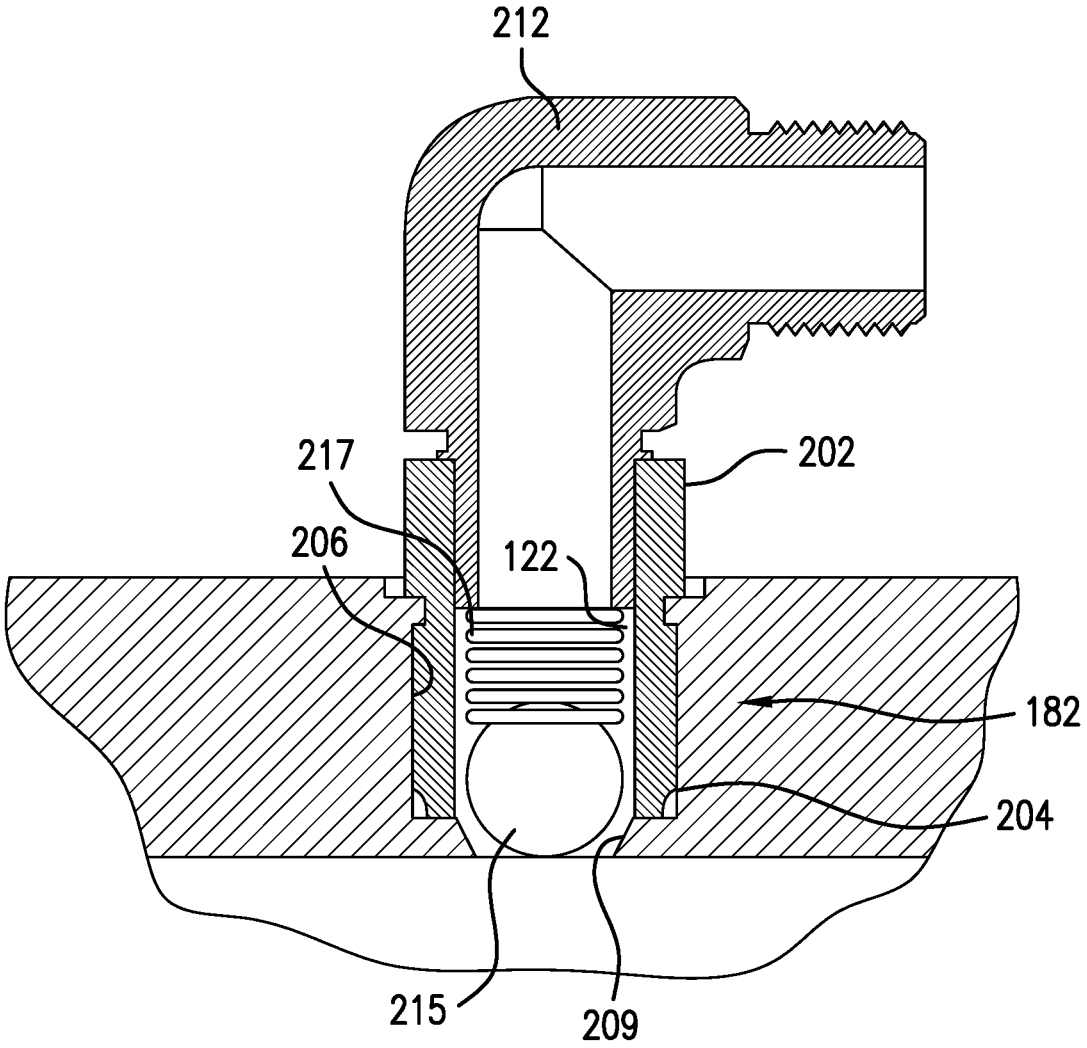
FIG. 9 depicts a cross-sectional side view of the selectively openable communication port of FIG. 9 in an open configuration, in accordance with an aspect of an exemplary embodiment.

Reference will now follow to FIGS. 7-9, wherein like reference numbers represent corresponding parts in the separate views, in describing a nozzle shuttle 180 and selectively openable port adapter 182 in accordance with another exemplary aspect. Nozzle shuttle 180 includes an outer surface 185 including a travel stop 189 that may interact with shoulder 137 in conduit 117 so as to limit axial travel. A seal 191 is arranged on outer surface 185 and abuts the inner surface (not separately labeled) of conduit 117. Nozzle shuttle 180 supports a nozzle 193 as shown in FIG. 7.

In an embodiment, port adapter 182 includes a first end 202, a second end 204 and a central passage 206 extending therebetween. Second end 204 is positioned at a reduced diameter section 209 defined in flow port 122. A nipple 212 is connected at first end 202. Nipple 212 includes a ball valve (not separately labeled) including a check ball 215 is supported at reduced diameter section 209 and biased toward conduit 117 by a spring 217 as shown in FIG. 8. Spring 217 extends between check ball 215 and nipple 212. Check ball 215 not only prevents debris from entering selectively openable port adapter 182 but also promotes an internal pressure balance between annular pressure and pressure within conduit 117. By balancing pressure, collapse of nipple 212 and any connected hydraulic lines that could affect fluid communication may be avoided. Spring 217 includes a spring constant that maintains check ball 215 on second end 214 yet allows pressure within conduit 117 to unseat check ball 215 to create a pressure balance as needed.

Once window cutting system 50 is at the selected depth, operators may then position whipstock 82 at a selected orientation. Once in the selected orientation, fluid pressure may be increased to compress the spring to allow pressure communication to to the anchor/packer as shown in FIG. 9. With the communication to the port open the operator can increase the flow to produce the required pressure to activate/set the anchor/packer. At this point, it should be understood that exemplary embodiments describe a system that facilitates hydraulic communication functions without concern that running in and positioning the whipstock will clog a hydraulic communication port. That is, the port remains closed until needed and thus remains clear of debris. When needed, the port is opened by increased flow rate to create a pressure drop behind the nozzle and hydraulic communications operations may commence. Upon completion, flow may be increased to set the anchor of the window cutting system before the window is formed.

Set forth below are some embodiments of the foregoing disclosure:

Embodiment 1. A window mill positionable in a wellbore having an annulus, the window mill comprising: a mill body having an outer surface, a conduit extending axially through the mill body, and a flow port extending from the conduit through the outer surface; a nozzle shuttle including a nozzle arranged in the conduit, the nozzle shuttle selectively extending over the flow port; and a selectively openable port adapter extending between the flow port and the nozzle shuttle, the selectively openable port adapter being responsive to fluid pressure to fluidically expose the conduit to the annulus through the flow port.

Embodiment 2. The window mill according to any prior embodiment, wherein, the port adapter extends through the selectively openable flow port into the conduit.

Embodiment 3. The window mill according to any prior embodiment, wherein the nozzle shuttle includes an outer surface having a recess, the port adapter extending into the recess to selectively affix the nozzle shuttle in the conduit.

Embodiment 4. The window mill according to any prior embodiment, wherein the port adapter includes a shear zone configured to fracture when exposed to a selected pressure to release the nozzle shuttle.

Embodiment 5. The window mill according to any prior embodiment, wherein the port adapter includes a central passage including a closed end portion positioned outwardly of the shear zone.

Embodiment 6. The window mill according to any prior embodiment, wherein the port adapter includes a central passage selectively fluidically connecting the conduit and the annulus.

Embodiment 7. The window mill according to any prior embodiment, further comprising: a ball valve including a check ball and a spring arranged in the central passage.

Embodiment 8. A resource exploration and recovery system comprising: a surface system; a sub-surface system including a tubular string extending into a borehole and surrounded by an annulus, the tubular string supporting a bottom hole assembly having a window mill coupled to a whipstock, the window mill comprising: a mill body having an outer surface, a conduit extending axially through the mill body, and a flow port extending from the conduit through the outer surface; a nozzle shuttle including a nozzle arranged in the conduit, the nozzle shuttle selectively extending over the flow port; and a selectively openable port adapter extending between the flow port and the nozzle shuttle, the selectively openable port adapter being responsive to fluid pressure to fluidically expose the conduit to the annulus through the flow port.

Embodiment 9. The resource exploration and recovery system according to any prior embodiment, wherein the port adapter extends through the selectively openable flow port into the conduit.

Embodiment 10. The resource exploration and recovery system according to any prior embodiment, wherein the nozzle shuttle includes an outer surface having a recess, the port adapter extending into the recess to selectively affix the nozzle shuttle in the conduit.

Embodiment 11. The resource exploration and recovery system according to any prior embodiment, wherein the port adapter includes a shear zone configured to fracture when exposed to a selected pressure to release the nozzle shuttle.

Embodiment 12. The resource exploration and recovery system according to any prior embodiment, wherein the port adapter includes a central passage including a closed end portion positioned outwardly of the shear zone.

Embodiment 13. The resource exploration and recovery system according to any prior embodiment, wherein the port adapter includes a central passage selectively fluidically connecting the conduit and the annulus.

Embodiment 14. The resource exploration and recovery system according to any prior embodiment, further comprising: a ball valve including a check ball and a spring arranged in the central passage.

Embodiment 15. A method of anchoring a whipstock in a wellbore comprising: running a tubular string including a window cutting system having a window mill and a whipstock into a wellbore; orienting the whipstock at a selected direction; flowing fluid into the window cutting system into the window mill; opening a port adapter with the flow of fluid; and passing the flow of fluid through the port adaptor into an annulus of the wellbore.

Embodiment 16. The method according to any prior embodiment, wherein opening the port adaptor includes shifting a nozzle and shearing off a closed end portion of the port adaptor with the nozzle.

Embodiment 17. The method according to any prior embodiment, wherein shearing off the closed end portion includes fracturing a shear zone in the port adaptor with the nozzle shuttle.

Embodiment 18. The method according to any prior embodiment, wherein opening the port adaptor includes unseating a check ball with the fluid.

Embodiment 19. The method according to any prior embodiment, wherein unseating the check ball includes compressing a spring in the port adaptor with the fluid.

Embodiment 20. The method according to any prior embodiment, further comprising: flowing the fluid through a nozzle in the nozzle shuttle through the window mill to set an anchor securing the whipstock at the selected direction.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another.

The terms "about" and "substantially" are intended to include the degree of error associated with measurement of the particular quantity based upon the equipment available at the time of filing the application. For example, "about" and/or "substantially" can include a range of ±8% or 5%, or 2% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A window mill positionable in a wellbore having an annulus, the window mill comprising:

a mill body having an outer surface, a conduit extending axially through the mill body, and a flow port extending from the conduit through the outer surface;

a nozzle shuttle including a central passage and a nozzle arranged in the central passage, the nozzle having a tapered wall forming a restriction, the nozzle shuttle selectively extending over the flow port; and a selectively openable port adapter extending between the flow port and the nozzle shuttle, the nozzle shuttle being responsive to an increase in fluid pressure to open the selectively openable port adaptor creating an unobstructed flow path from the conduit to the annulus defined radially outwardly of the mill body.

2. The window mill according to claim 1, wherein, the port adapter extends through the selectively openable flow port into the conduit.

3. The window mill according to claim 2, wherein the nozzle shuttle includes an outer surface having a recess, the port adapter extending into the recess to selectively affix the nozzle shuttle in the conduit.

4. The window mill according to claim 3, wherein the port adapter includes a shear zone configured to fracture when exposed to a selected pressure to release the nozzle shuttle.

5. The window mill according to claim 4, wherein the port adapter includes a central passage including a closed end portion positioned outwardly of the shear zone.

6. The window mill according to claim 2, wherein the port adapter includes a central passage selectively fluidically connecting the conduit and the annulus.

7. The window mill according to claim 6, further comprising: a ball valve including a check ball and a spring arranged in the central passage.

8. A resource exploration and recovery system comprising:

a surface system;

a sub-surface system including a tubular string extending into a borehole and surrounded by an annulus, the tubular string supporting a bottom hole assembly having a window mill coupled to a whipstock, the window mill comprising:

a mill body having an outer surface, a conduit extending axially through the mill body, and a flow port extending from the conduit through the outer surface;

a nozzle shuttle including a central passage and a nozzle arranged in the central passage, the nozzle having a tapered wall forming a restriction, the nozzle shuttle selectively extending over the flow port; and a selectively openable port adapter extending between the flow port and the nozzle shuttle, the nozzle shuttle being responsive to an increase in fluid pressure to open the selectively openable port adaptor creating an unobstructed flow path from the conduit to the annulus defined radially outwardly of the mill body.

9. The resource exploration and recovery system according to claim 8, wherein the port adapter extends through the selectively openable flow port into the conduit.

10. The resource exploration and recovery system according to claim 9, wherein the nozzle shuttle includes an outer surface having a recess, the port adapter extending into the recess to selectively affix the nozzle shuttle in the conduit.

11. The resource exploration and recovery system according to claim 10, wherein the port adapter includes a shear zone configured to fracture when exposed to a selected pressure to release the nozzle shuttle.

12. The resource exploration and recovery system according to claim 11, wherein the port adapter includes a central passage including a closed end portion positioned outwardly of the shear zone.

13. The resource exploration and recovery system according to claim 9, wherein the port adapter includes a central passage selectively fluidically connecting the conduit and the annulus.

14. The resource exploration and recovery system according to claim 13, further comprising: a ball valve including a check ball and a spring arranged in the central passage.

15. A method of anchoring a whipstock in a wellbore comprising:

running a tubular string including a window cutting system having a window mill and a whipstock into a wellbore;

orienting the whipstock at a selected direction;

flowing fluid into the window cutting system into the window mill;

opening a port adapter with the flow of fluid creating an unobstructed flow path from the tubular string through the window mill; and passing the flow of fluid through the port adaptor into an annulus of the wellbore defined radially outwardly of the window mill and the whipstock.

16. The method of claim 15, wherein opening the port adaptor includes shifting a nozzle shuttle and shearing off a closed end portion of the port adaptor with the nozzle.

17. The method of claim 16, wherein shearing off the closed end portion includes fracturing a shear zone in the port adaptor with the nozzle shuttle.

18. The method of claim 15, wherein opening the port adaptor includes unseating a check ball with the fluid.

19. The method of claim 18, wherein unseating the check ball includes compressing a spring in the port adaptor with the fluid.

20. The method of claim 16, further comprising: flowing the fluid through a nozzle having a tapered wall forming a restriction in the nozzle shuttle through the window mill to set an anchor securing the whipstock at the selected direction.

* * * * *